US009982510B2

(12) United States Patent
Vick, Jr. et al.

(10) Patent No.: US 9,982,510 B2
(45) Date of Patent: May 29, 2018

(54) EXPANDING PISTON FOR A SUBSURFACE SAFETY VALVE

(71) Applicant: Halliburton Energy Services, Inc., Houston, TX (US)

(72) Inventors: James Dan Vick, Jr., Dallas, TX (US); Bruce Edward Scott, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 876 days.

(21) Appl. No.: 14/382,608

(22) PCT Filed: Nov. 11, 2013

(86) PCT No.: PCT/US2013/069395
§ 371 (c)(1),
(2) Date: Sep. 3, 2014

(87) PCT Pub. No.: WO2015/069289
PCT Pub. Date: May 14, 2015

(65) Prior Publication Data

US 2015/0218907 A1 Aug. 6, 2015

(51) Int. Cl.
*E21B 34/10* (2006.01)
*E21B 33/12* (2006.01)
*E21B 34/00* (2006.01)

(52) U.S. Cl.
CPC ..... *E21B 34/10* (2013.01); *E21B 33/1208* (2013.01); *E21B 2034/005* (2013.01)

(58) Field of Classification Search
CPC ..... E21B 34/10; E21B 33/1208; E21B 34/00; E21B 2034/005; F16J 15/32; F16J 15/16
See application file for complete search history.

(56) References Cited

U.S. PATENT DOCUMENTS 4,161,219 A 7/1979 Pringle
4,234,043 A 11/1980 Roberts
(Continued)

FOREIGN PATENT DOCUMENTS

WO 2015069289 A1 5/2015
WO 2015072994 A1 5/2015
(Continued)

OTHER PUBLICATIONS

International Search Report and Written Opinion for PCT/US2013/069395 dated Aug. 6, 2014.
(Continued)

*Primary Examiner* — Wei Wang
(74) *Attorney, Agent, or Firm* — McDermott Will & Emery LLP

(57) ABSTRACT

Disclosed are subsurface safety valves having an expanding piston used to increase the opening force for the safety valve. One disclosed safety valve includes a housing having a piston bore defined therein and configured to receive hydraulic fluid pressure, the piston bore providing a tapered portion having a first end and a second end, wherein a cross-sectional diameter of the tapered portion progressively increases from the first end to the second end, and a piston assembly movably arranged within the piston bore and comprising a piston rod that extends longitudinally within at least a portion of the piston bore and an expanding piston coupled to the piston rod, wherein the expanding piston is configured to move between a contracted configuration and an expanded configuration to sealingly engage the tapered portion as the piston assembly moves between the first and second ends.

21 Claims, 8 Drawing Sheets

(56) References Cited

U.S. PATENT DOCUMENTS

| | | | |
|---|---|---|---|
| 4,252,197 | A | 2/1981 | Pringle |
| 4,452,310 | A | 6/1984 | Pringle et al. |
| 4,588,030 | A | 5/1986 | Blizzard |
| 4,986,357 | A | 1/1991 | Pringle |
| 5,284,205 | A | 2/1994 | Smith |
| 6,003,605 | A | 12/1999 | Dickson et al. |
| 6,098,714 | A | 8/2000 | Deaton |
| 6,427,778 | B1 | 8/2002 | Beall et al. |
| 2003/0205389 | A1 | 11/2003 | Deaton et al. |
| 2004/0069502 | A1 | 4/2004 | Luke |
| 2006/0196669 | A1 | 9/2006 | Lauderdale et al. |
| 2008/0128137 | A1 | 6/2008 | Anderson et al. |
| 2013/0043039 | A1 | 2/2013 | Sloan et al. |
| 2013/0092396 | A1 | 4/2013 | Webber et al. |
| 2015/0211333 | A1 | 7/2015 | Vick, Jr. et al. |

FOREIGN PATENT DOCUMENTS

| | | | |
|---|---|---|---|
| WO | 2015102603 | A1 | 7/2015 |
| WO | 2015102604 | A1 | 7/2015 |

OTHER PUBLICATIONS

International Search Report and Written Opinion for PCT/US2013/078432 dated Sep. 29, 2014.

International Search Report and Written Opinion for PCT/US2013/078440 dated Sep. 23, 2014.

EXPANDING PISTON FOR A SUBSURFACE SAFETY VALVE

BACKGROUND

The present disclosure relates generally to operations performed and equipment utilized in conjunction with subterranean wells and, in particular, to subsurface safety valves having an expanding piston used to increase the opening force for the safety valve and to reduce the spread between the opening and closing pressures.

Subsurface safety valves are well known in the oil and gas industry and act as a failsafe to prevent the uncontrolled release of reservoir fluids in the event of a worst-case scenario surface disaster. Typical subsurface safety valves are flapper-type valves that are opened and closed with the help of a flow tube moving telescopically within the production tubular. The flow tube is often controlled hydraulically from the surface and is forced into its open position using a piston and rod assembly that may be hydraulically charged via a control line linked directly to a hydraulic manifold or pressure control system at the well surface. When sufficient hydraulic pressure is conveyed to the subsurface safety valve via the control line, the piston and rod assembly forces the flow tube downwards, which compresses a spring and simultaneously pushes the flapper downwards to the open position. When the hydraulic pressure is removed from the control line, the spring pushes the flow tube back up, which allows the flapper to move into its closed position.

Depending on the size and depth of the safety valve deployed, the components of the pressure control system used to operate the safety valve can be quite expensive. The cost of a pressure control system may increase with increasing required pressure ratings for the control line and/or the pump equipment, which is usually related to the operating depth of the safety valve. There are practical limits to the size and rating of pressure control systems, past which a well operator may not be able to economically or feasibly employ a subsurface safety valve. As the setting depths of such hydraulically-actuated subsurface safety valves continues to increase, the energy required to move the safety valve against the hydrostatic head acting on the hydraulic actuator also increases. For example, on conventional safety valves, suitable biasing means, such as a gas chamber or more usually a power spring, act on the hydraulic actuator to overcome the hydrostatic force. However, there are practical limits to maximizing biasing forces such as springs, and minimizing the hydraulic areas of a hydraulic piston and cylinder assembly. Generally, to move a small hydraulic piston and cylinder assembly against a high hydrostatic head requires a strong spring that results in a large "spread" in the operating pressure to move the safety valve from a first position to a second position. Increasing the spread requires a change in surface operating pressures. Moreover, the springs used in subsurface safety valves require very high pounds of force and length and therefore become quite expensive. Lastly, increasing the length of the valve to reduce the spread can also be costly as it requires a longer spring.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates generally to operations performed and equipment utilized in conjunction with subterranean wells and, in particular, to subsurface safety valves having an expanding piston used to increase the opening force for the safety valve and to reduce the spread between the opening and closing pressures.

Disclosed is a subsurface safety valve configured to reduce the pressure required to open the valve at depth and to reduce the spread between the opening and closing pressures. The safety valve includes a piston assembly having an expanding piston coupled to a piston rod that axially translates within a piston bore that has a tapered portion with a cross-sectional diameter that increases from a first end to a second end. As the piston assembly moves from the first end to the second end, the expanding piston moves from a contracted configuration to an expanded configuration, thereby also progressively increasing its piston area as the piston assembly advanced within the piston bore. As a result, hydraulic fluid provided to the piston bore is able to work on the larger piston area such that it increases its setting depth and otherwise reduces its control pressure requirements.

Figure 1:
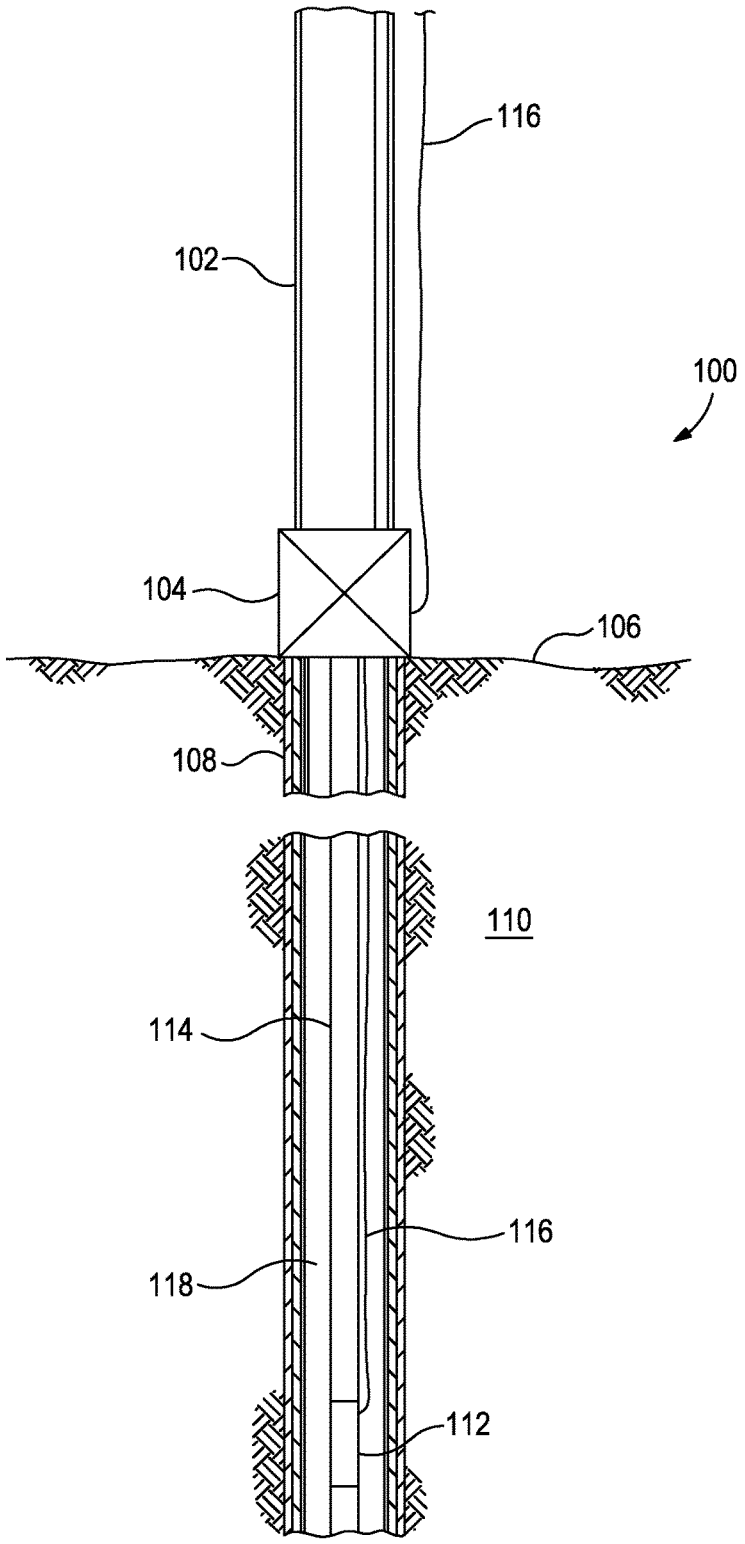
FIG. 1 is a well system that incorporates one or more principles of the present disclosure, according to one or more embodiments.

Referring to FIG. 1, illustrated is a well system 100 that incorporates one or more principles of the present disclosure, according to one or more embodiments. As illustrated, the well system 100 may include a riser 102 extending from a wellhead installation 104 arranged at a sea floor 106. The riser 102 may extend, for example, to an offshore oil and gas platform (not shown). A wellbore 108 extends downward from the wellhead installation 104 through various earth strata 110. The wellbore 108 is depicted as being cased, but it could equally be an uncased wellbore 108, without departing from the scope of the disclosure. Although FIG. 1 depicts the well system 100 in the context of an offshore oil and gas application, it will be appreciated by those skilled in the art that the various embodiments disclosed herein are equally well suited for use in or on oil and gas rigs or service rigs, such as land-based oil and gas rigs or rigs located at any other geographical site. Thus, it should be understood that the disclosure is not limited to any particular type of well.

The well system 100 may further include a safety valve 112 interconnected with a tubing string 114 arranged within the wellbore 108 and extending from the wellhead installation 104. The tubing string 114 may be configured to communicate fluids derived from the wellbore 108 and the surrounding subterranean formations to the well surface via the wellhead installation 104. A control line 116 may extend from the well surface and into the wellhead installation 104 which, in turn, conveys the control line 116 into an annulus 118 defined between the wellbore 108 and the tubing string 114. The control line 116 may extend downward within the annulus 118 and eventually become communicably coupled to the safety valve 112. As discussed in more detail below, the control line 116 may be configured to actuate the safety valve 112, for example, to maintain the safety valve 112 in an open position, or otherwise to close the safety valve 112 and thereby prevent a blowout in the event of an emergency.

The control line 116 may be a hydraulic conduit that provides hydraulic fluid pressure to the safety valve 112. In operation, hydraulic fluid may be applied to the control line 116 from a hydraulic pressure control system arranged at a remote location, such as at a production platform or a subsea control station. When properly applied, the hydraulic pressure derived from the control line 116 may be configured to open and maintain the safety valve 112 in its open position, thereby allowing production fluids to flow through the tubing string 114. To move the safety valve 112 from its open position and into a closed position, the hydraulic pressure in the control line 116 may be reduced or otherwise eliminated.

Although the control line 116 is depicted in FIG. 1 as being arranged external to the tubing string 114, it will be readily appreciated by those skilled in the art that any arrangement or configuration of the control line 116 may be used to convey actuation pressure to the safety valve 112. For example, the control line 116 could be arranged internal to the tubing string 114, or otherwise formed in a sidewall of the tubing string 114. The control line 116 could extend from a remote location, such as from the earth's surface, or another location in the wellbore 108. In yet other embodiments, the pressure required to actuate the control valve 112 may be derived from a pressure control system located downhole and communicably coupled to the control line 116 at a location.

In the following description of the representative embodiments of the disclosure, directional terms such as "above", "below", "upper", "lower", etc., are used for convenience in referring to the accompanying drawings. In general, "above", "upper", "upward" and similar terms refer to a direction toward the earth's surface along the wellbore 108, and "below", "lower", "downward" and similar terms refer to a direction away from the earth's surface along the wellbore 108.

Figure 2A:
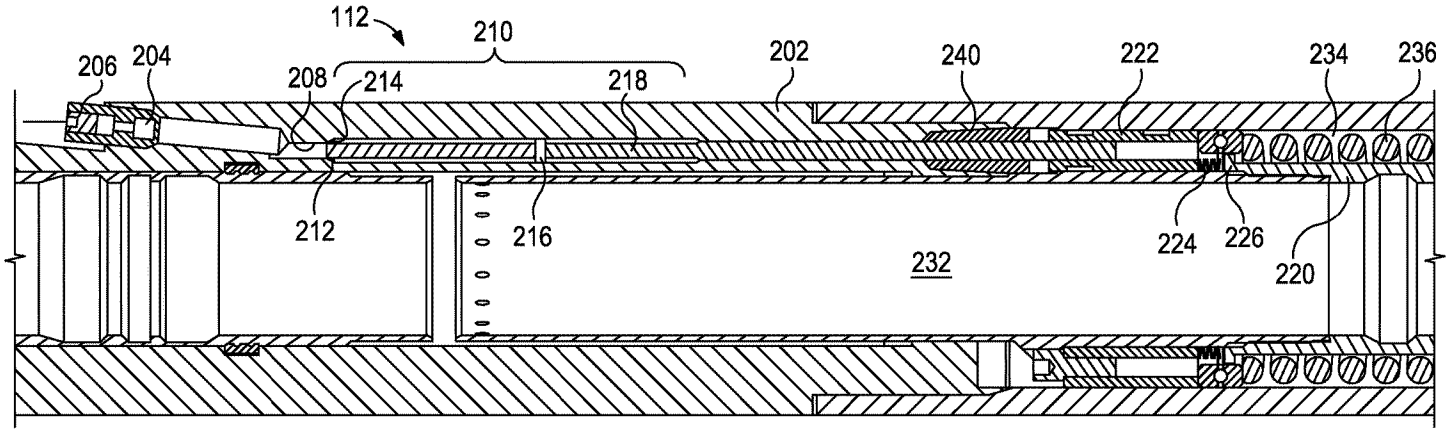
FIGS. 2A and 2B illustrate cross-sectional side views of the exemplary safety valve of FIG. 1, according to one or more embodiments.
Figure 2B:
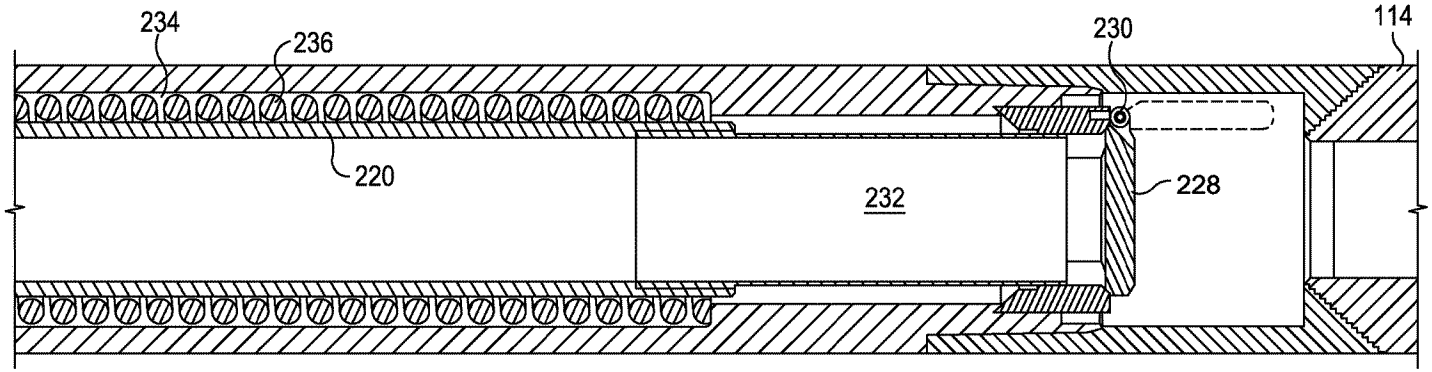

Referring now to FIGS. 2A and 2B, with continued reference to FIG. 1, illustrated are cross-sectional side views of an exemplary embodiment of the safety valve 112, according to one or more embodiments. In particular, the safety valve 112 is depicted in FIGS. 2A and 2B in successive sectional views, where FIG. 2A depicts an upper portion of the safety valve 112 and FIG. 2B depicts a lower portion of the safety valve 112. As illustrated, the safety valve 112 may include a housing 202 that is able to be coupled to the tubing string 114 at opposing ends of the housing 202 (tubing string 114 shown only in FIG. 2B).

A control line port 204 may be defined or otherwise provided in the housing 202 for connecting the control line 116 (FIG. 1) to the safety valve 112. The port 204 is shown in FIG. 2A as being plugged with a set screw 206 or other type of plugging device. When the control line 116 is appropriately connected to the first port 204, however, the control line 116 is placed in fluid communication with a piston bore 208 and able to convey hydraulic fluid pressure thereto. The piston bore 208 may be an elongate channel or conduit defined within the housing 202 and configured to extend longitudinally along a portion of the axial length of the safety valve 112.

A piston assembly 210 may be arranged within the piston bore 208 and configured to translate axially therein. The piston assembly 210 may include a piston head 212 configured to mate with and otherwise bias an up stop 214 defined within the piston bore 208 when the piston assembly 210 is forced upwards in the direction of the control line port 204. The up stop 214 may be a radial shoulder defined within the piston bore 208 and having a reduced diameter and an axial surface configured to engage a corresponding axial surface of the piston head 212. In other embodiments, the up stop 214 may be any device or means arranged within the piston bore 208 that is configured to stop the axial movement of the piston assembly 210 as it advances within the piston bore 208 toward the control line port 204.

As illustrated, the piston assembly 210 may also include a piston 216 operatively coupled to the piston head 212 and movably arranged within the piston bore 208. As discussed in greater detail below, the piston bore 208 may be tapered and the piston 216 may be an expanding-type piston configured to progressively expand to thereby sealingly engage the piston bore 208 as it axially translates therein. The piston assembly 210 may include a piston rod 218 that is coupled to or otherwise extends longitudinally from the piston 216 through at least a portion of the piston bore 208. At a distal end thereof, the piston rod 218 may be operatively coupled to a flow tube 220 that is movably arranged within the safety valve 112. More particularly, the piston rod 218 may be coupled to an actuator sleeve 222, and the actuator sleeve 222 may engage a biasing device 224 (e.g., a compression spring, a series of Belleville washers, or the like) arranged axially between the actuator sleeve 222 and an actuation flange 226. The actuation flange 226 forms part of the proximal end of the flow tube 220. As the actuator sleeve 222 acts on the biasing device 224 (e.g., axial force), the actuation flange 226 and the flow tube 220 correspondingly move.

Referring to FIG. 2B, the safety valve 112 may also include a valve closure device 228 that selectively opens and closes a flow passage 232 defined through the interior of the safety valve 112. The valve closure device 228 may be a flapper, as generally known to those skilled in the art. It should be noted, however, that although the safety valve 112 is depicted as being a flapper-type safety valve, those skilled in the art will readily appreciate that any type of closure device 228 may be employed, without departing from the scope of the disclosure. For example, in some embodiments, the closure device 228 could instead be a ball, a sleeve, etc.

As shown in FIG. 2B, the closure device 228 is shown in its closed position whereby the closure device 228 is able to substantially block fluid flow into and through the flow passage 232 from downhole. A torsion spring 230 biases the closure device 228 to pivot to its closed position. The piston assembly 210 is used to displace the flow tube 220 downward (i.e., to the right in FIG. 2B) to engage the closure device 228 and overcome the spring force of the torsion spring 230. When the flow tube 220 is extended to its downward position, it engages and moves the closure device 228 from its closed position to an open position (shown in phantom as dashed lines). When the flow tube 220 is displaced back upward (i.e., to the left in FIG. 2B), the torsion spring 230 is able to pivot the closure device 228 back to its closed position. Axial movement of the piston assembly 210 within the piston bore 208 will force the flow tube 220 to correspondingly move axially within the flow passage 232, and either open the closure device 228 or allow it to close, depending on its relative position.

The safety valve 112 may further define a lower chamber 234 within the housing 202. In some embodiments, the lower chamber 234 may form part of the piston bore 208, such as being an elongate extension thereof. A power spring 236, such as a coil or compression spring, may be arranged within the lower chamber 234. The power spring 236 may be configured to bias the actuation flange 226 and actuation sleeve 222 upwardly which, in turn, biases the piston assembly 210 in the same direction. Accordingly, expansion of the power spring 236 will cause the piston assembly 210 to move upwardly within the piston bore 208.

It should be noted that while the power spring 236 is depicted as a coiled compression spring, any type of biasing device may be used instead of, or in addition to, the power spring 236, without departing from the scope of the disclosure. For example, a compressed gas, such as nitrogen, with appropriate seals may be used in place of the power spring 236. In other embodiments, the compressed gas may be contained in a separate chamber and tapped when needed.

In exemplary operation, the safety valve 112 may be actuated in order to open the closure device 228. This may be accomplished by conveying hydraulic fluid under pressure (i.e., control pressure) to the control line port 204 via the control line 116 (FIG. 1). As hydraulic pressure is provided to the piston bore 208, the piston 216 assumes the hydraulic force and the piston assembly 210 is forced to move axially downward within the piston bore 208. As the piston assembly 210 moves, the piston rod 218 mechanically transfers the hydraulic force to the actuation sleeve 222 and the actuation flange 226, thereby correspondingly displacing the flow tube 220 in the downward direction. In other words, as the piston assembly 210 moves axially within the piston bore 208, the flow tube correspondingly moves in the same direction. As the flow tube 220 moves downward, it engages the closure device 228, overcomes the spring force of the torsion spring 230, and thereby pivots the closure device 228 to its open position to permit fluids to enter the flow passage 232 from below.

Moreover, as the piston assembly 210 moves axially downward within the piston bore 208, the power spring 236 is compressed within the lower chamber 234 and progressively builds spring force. In at least one embodiment, the piston assembly 210 will continue its axial movement in the downward direction, and thereby continue to compress the power spring 236, until engaging a down stop 240 (FIG. 2A) arranged within the piston bore 208. A metal-to-metal seal may be created between the piston assembly 210 and the down stop 240 such that the migration of fluids (e.g., hydraulic fluids, production fluids, etc.) therethrough is generally prevented.

Upon reducing or eliminating the hydraulic pressure provided to the piston bore 208 via the control line 116, the spring force built up in the power spring 236 may be allowed to release and displace the piston assembly 210 upwards within the piston bore 208, thereby correspondingly moving the flow tube 220 in the same direction. The pressure within the safety valve 112 below the piston 216 (i.e., the section pressure) also helps move the piston assembly 210 upwards within the piston bore 208. As the flow tube 220 moves axially upwards, it will eventually move out of engagement with the closure device 228, thereby allowing the spring force of the torsion spring 230 to pivot the closure device 228 back into its closed position.

In at least one embodiment, the piston assembly 210 will continue its axial movement in the upward direction until the piston head 212 engages the up stop 214 and effectively prevents the piston assembly 210 from further upward movement. Engagement between the piston head 212 and the up stop 214 may generate a mechanical metal-to-metal seal between the two components to prevent the migration of fluids (e.g., hydraulic fluids, production fluids, etc.) therethrough.

Figure 3A:
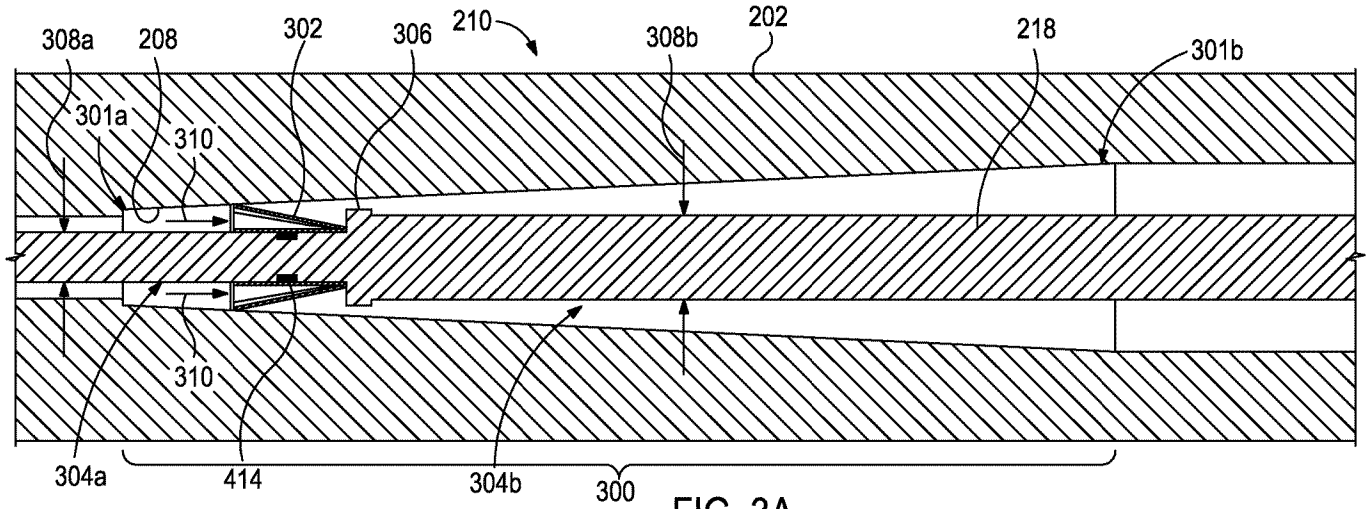
FIGS. 3A and 3B illustrate enlarged cross-sectional side views of an exemplary embodiment of the piston assembly of FIG. 2A, according to one or more embodiments.
Figure 3B:
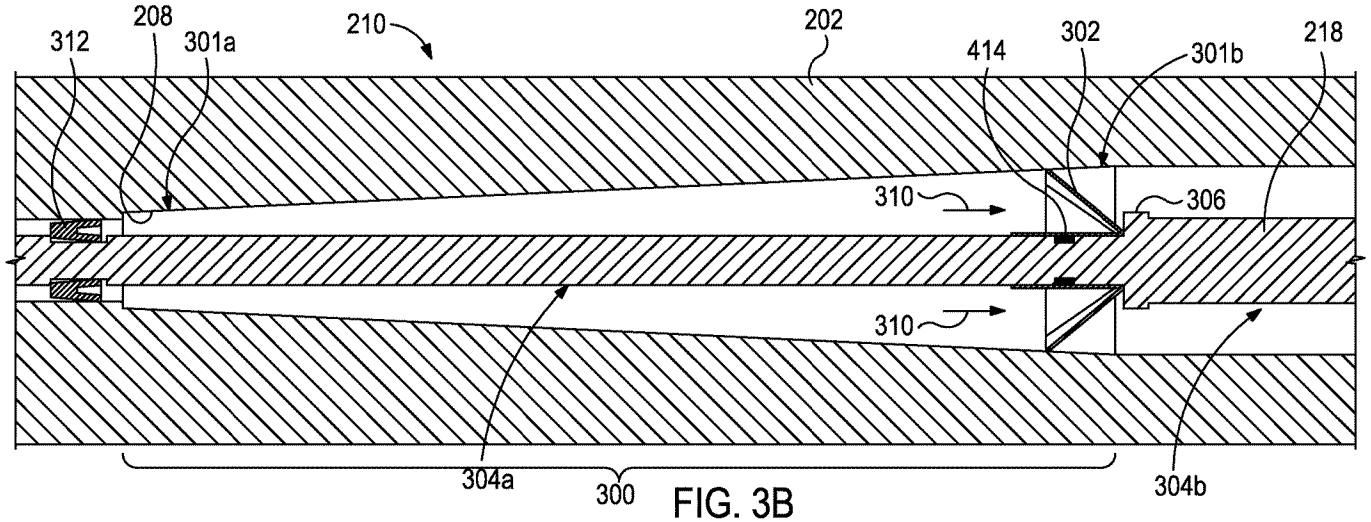

Referring now to FIGS. 3A and 3B, with continued reference to FIGS. 2A and 2B, illustrated are enlarged cross-sectional side views of an exemplary embodiment of the piston assembly 210, according to one or more embodiments. Like numerals in FIGS. 3A and 3B that are used in prior figures indicate like elements and/or components that may not be described again in detail. FIG. 3A depicts the piston assembly 210 in a first position, where the safety valve 112 (FIGS. 2A-2B) is closed, as generally discussed above. FIG. 3B depicts the piston assembly 210 in a second position, where the safety valve 112 has been opened (or is in the process of being opened), as also generally discussed above.

As illustrated, the piston assembly 210 may be arranged within the piston bore 208 defined in the housing 202 of the safety valve 112 (FIGS. 2A-2B). The piston bore 208 may include a tapered portion 300 having a first end 301*a* and a second end 301*b*, wherein the first end 301*a* exhibits a smaller diameter than the second end 301*b*, and the cross-sectional diameter of the tapered portion 300 progressively increases from the first end 301*a* to the second end 301*b*. As a result, the piston bore 208 provides a progressively increasing cross-sectional area that may be exposed to hydraulic fluid as the piston assembly 210 moves between its first and second positions. As illustrated, the cross-sectional diameter of the tapered portion 300 progressively increases in the downhole direction (i.e., to the right in FIGS. 3A and 3B). Those skilled in the art, however, will readily appreciate that in certain embodiments the function of the safety valve 112 may be reversed such that the cross-sectional diameter of the tapered portion 300 may alternatively progressively increase in the uphole direction (i.e., to the left in FIGS. 3A and 3B), without departing from the scope of the disclosure.

The piston assembly 210 may include an expanding piston 302 configured to expand and sealingly engage the inner wall of the tapered portion 300 as the piston assembly 210 moves between the first and second ends 301*a,b*. The expanding piston 302 may be configured to move between a contracted configuration, as shown in FIG. 3A, and an expanded configuration, as shown in FIG. 3B. As illustrated, the expanding piston 302 may be mounted on or otherwise coupled to the piston rod 218. In some embodiments, the piston rod 218 may have an upper portion 304*a* and a lower portion 304*b*, and the expanding piston 302 may be generally arranged on the piston rod 218 at a transition point or location between the upper and lower portions 304*a,b*. In the illustrated embodiment, the piston rod 218 may define a radial shoulder 306 that serves as the transition point between the upper and lower portions 304*a,b*.

Figure 5:
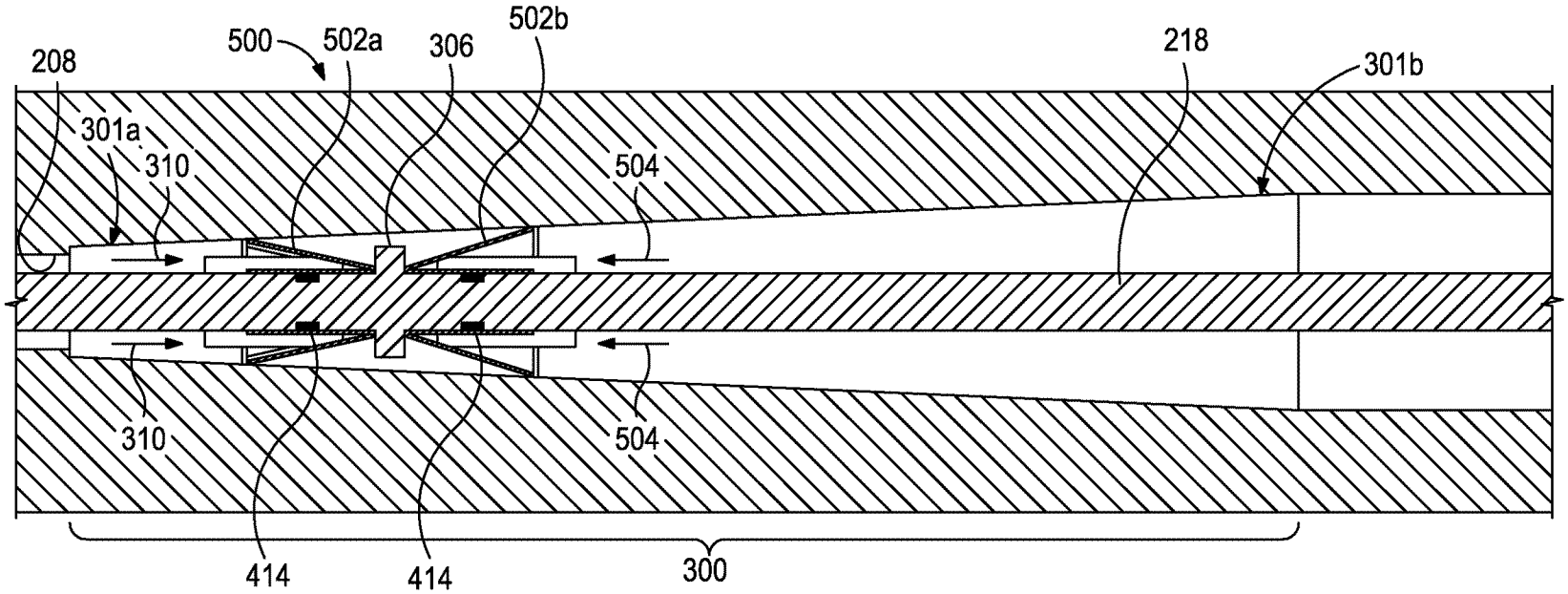
FIG. 5 illustrates an enlarged cross-sectional view of another embodiment of a piston assembly, according to one or more embodiments.

The upper portion 304*a* may exhibit a first diameter 308*a* and the lower portion 304*b* may exhibit a second diameter 308*b*. In some embodiments, the first diameter 308*a* may be smaller than the second diameter 308*b*, as depicted in FIGS. 3A and 3B. In other embodiments, however, the first diameter 308*a* may be greater than the second diameter 308*b*, without departing from the scope of the disclosure. In yet other embodiments, the first and second diameters 308*a,b* of the piston rod 218 may be substantially the same, such as is depicted in FIG. 5.

Figure 4A:
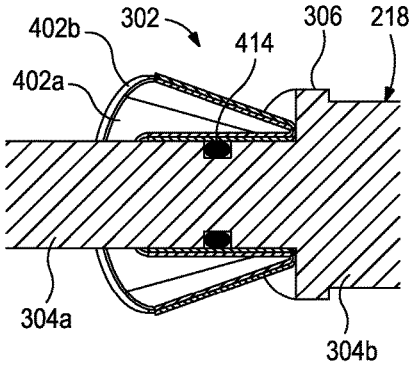
FIGS. 4A-4C illustrate various views of the expanding piston of FIGS. 3A and 3B in its contracted configuration, according to one or more embodiments.
Figure 4B:
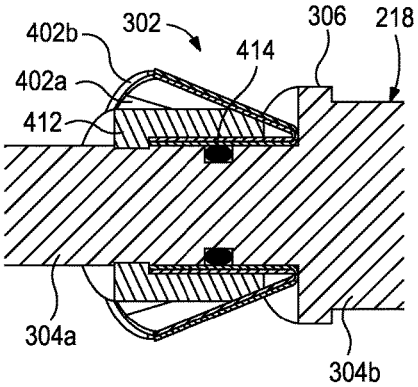
Figure 4C:
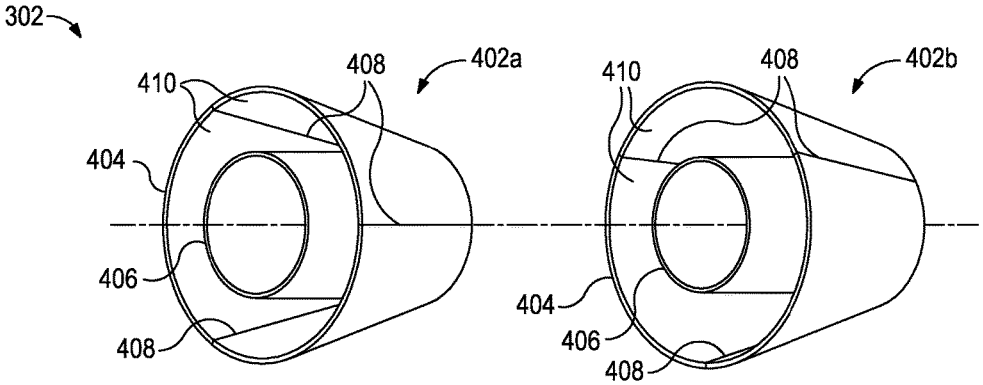

Referring to FIGS. 4A-4C, illustrated are various views of the expanding piston 302 in its contracted configuration. More specifically, FIGS. 4A and 4B depict cross-sectional side views of the expanding piston 302 as mounted on the piston rod 218 and FIG. 4C depicts an exploded isometric view of the expanding piston 302. As illustrated, the expanding piston 302 may include a first or inner expandable cone 402*a* and a second or outer expandable cone 402*b*. While only two expandable cones 402*a,b* are depicted, it will be appreciated that more than two expandable cones 402*a,b* may be used, without departing from the scope of the disclosure.

As best seen in FIG. 4C, each of the first and second expandable cones 402*a,b* may include an outer shroud 404 and an inner cylinder 406. The shroud 404 of each of the first and second expandable cones 402*a,b* may have a plurality of longitudinal cuts or slots 408 defined therein, thereby defining a corresponding plurality of leaves 410 in the shroud 404. As will be appreciated, the slots 408 may prove advantageous in allowing the leaves 410 of each shroud 404 to radially expand when not constrained, such as when not constrained by the inner wall of the piston bore 208 (FIGS. 3A and 3B).

The first expandable cone 402*a* may be configured to nest within the second expandable cone 402*b*. More particularly, the outer shroud 404 and inner cylinder 406 of the first expandable cone 402*a* may be configured to generally interpose the outer shroud 404 and inner cylinder 406 of the second expandable cone 402*b* in a generally nested relationship.

The interface between the first and second expandable cones 402*a,b* and, more particularly, between the corresponding leaves 410 of each shroud 404 may be generally sealed. In some embodiments, for example, the slots 408 defined in the outer shrouds 404 of each of the first and second expandable cones 402*a,b* may be angularly offset or misaligned with each other, thereby providing a tortuous flow path for any fluids attempting to migrate past the expanding piston 302 via the slots 408. In other embodiments, the interface between the corresponding leaves 410 of the first and second expandable cones 402*a,b* may provide a metal-to-metal seal, thereby substantially preventing fluid migration through the expanding piston 302. In yet other embodiments, a sealant (not shown) may be disposed between the first and second expandable cones 402*a,b* such that the corresponding leaves 410 of each shroud 404 may be generally sealed. The sealant may include a layer of elastomer, rubber, or a thermoplastic (e.g., TEFLON®). In other embodiments, a combination of two or more of the preceding sealing methods may be employed to provide a generally sealed expanding piston 302 as it moves within the piston bore 208. Additionally, at least one of the expandable cones 402*a,b* may include a seal(s) positioned radially along its outer edge or portion of the expandable cone(s) 402*a,b* that contact the inner wall of the tapered portion 300 (FIGS. 3A and 3B).

As depicted in FIGS. 4A and 4B, the expanding piston 302 may be mounted on the piston rod 218 and, more particularly, on the upper portion 304*a* of the piston rod 218. In some embodiments, the expanding piston 302 may be welded or brazed to the piston rod 218. In other embodiments, the expanding piston 302 may attached to the piston rod 218 by heat shrinking methods. In yet other embodiments, the expanding piston 302 may be coupled to the piston rod 218 using one or more mechanical fasteners (e.g., screws, bolts, snap rings, pins, etc.) or an industrial adhesive or the like. In one or more additional embodiments, a retainer ring 412 (shown in FIG. 4B) may be used to secure the expanding piston 302 to the piston rod 218. The retainer ring 412 may be coupled or otherwise attached to the piston rod 218 by welding, brazing, heat shrinking, mechanical fasteners, and/or adhesives, and thereby maintain the expanding piston 302 in place on the piston rod 218.

The expanding piston 302 may be mounted on the piston rod 218 such that a distal end of the expanding piston 302 biases the radial shoulder 306. This axial arrangement between the expanding piston 302 and the radial shoulder 306 may prove advantageous in holding pressure within the piston bore 208 (FIGS. 3A and 3B) as the expanding piston 302 axially translates and simultaneously expands its leaves 410 radially outwards. More specifically, as the hydraulic pressure conveyed to the piston bore 208 above the piston assembly 210 is captured and assumed by the expanding piston 302, at least a portion of the hydraulic force may be transferred to the piston rod 218 via the radial shoulder 306, which prevents the expanding piston 302 from sliding along the outer surface of the piston rod 218 and instead forces the piston rod 218 to move.

In some embodiments, the expanding piston 302 may further include one or more sealing elements 414 used to seal the interface between the expanding piston 302 and the piston rod 218. As illustrated, the sealing element 414 may be an O-ring, or the like, but may equally be any type of sealing device or apparatus known to those skilled in the art. In operation, the sealing element 414 may be configured to prevent fluids from migrating across the interface between the inner cylinder 406 of the second expandable cone 402*b* and the piston rod 218.

Figure 4D:
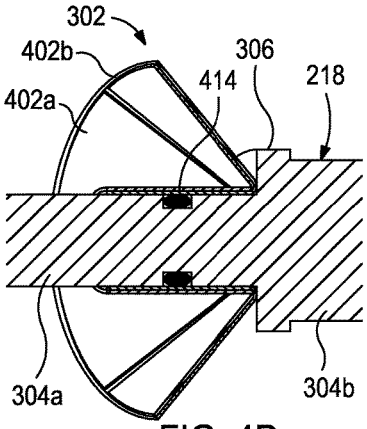
FIGS. 4D and 4E illustrate views of the expanding piston of FIGS. 3A and 3B in its expanded configuration, according to one or more embodiments.
Figure 4E:
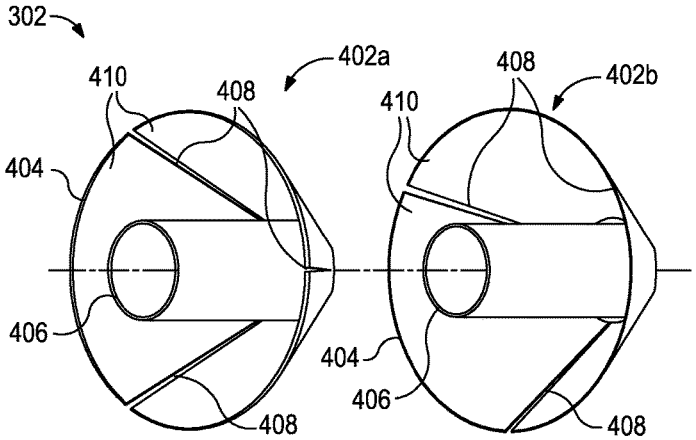

Referring to FIGS. 4D and 4E, with continued reference to FIGS. 4A-4C, illustrated are views of the expanding piston 302 in its expanded configuration. More specifically, FIG. 4D depicts a cross-sectional side view of the expanding piston 302 as mounted on the piston rod 218 in the expanded configuration, and FIG. 4E depicts an exploded isometric view of the expanding piston 302 in the expanded configuration. The relaxed state for the expanding piston 302 may be the expanded configuration. Accordingly, placing the expanding piston 302 in the contracted configuration may load the first and second expandable cones 402*a,b* with spring force that is able to progressively release as the piston assembly 210 moves axially within the tapered portion 300 (FIGS. 3A and 3B) of the piston bore 208 from the first end 301*a* to the second end 301*b*.

The first and second expandable cones 402*a,b* may be made of a material that is able to bend or otherwise flex such that each are able to be loaded with spring force in the contracted configuration. In some embodiments, for example, the first and second expandable cones 402*a,b* may be made of metal, such as spring steel, and any alloys of stainless steel. In other embodiments, the first and second expandable cones 402*a,b* may be made any material that is able to remain in its elastic range during operation and have suitable fatigue resistance. In some embodiments, the first expandable cone 402*a* (or an intermediate expandable cone when using more than two expandable cones) may be function as a sealing member while the second expandable cone 402*b* may function as a structural member. In such embodiments, the first expandable cone 402*a* may be made of one or more elastomers, thermoplastics, or other appropriate sealing materials.

Referring again to FIGS. 3A-3B, exemplary operation of the piston assembly 210 is now provided. In FIG. 3A, the safety valve 112 (FIGS. 2A-2B) is in its closed position, the piston assembly 210 is in its first position, and the expanding piston 302 is in its contracted configuration as arranged at or near the first end 301*a* of the tapered portion 300 of the piston bore 208. As a result, spring force is built up or otherwise loaded in the expanding piston 302 and the expanding piston 302 sealingly engages the inner wall of the piston bore 208. To move the piston assembly 210 from the first position to the second position, and thereby move the safety valve 112 (FIGS. 2A-2B) from the closed position toward the open position, hydraulic pressure or "control" pressure 310 is introduced into the piston bore 208 via the control line 116 (FIG. 1) and associated port 204 (FIG. 2A). The control pressure 310 communicates with and otherwise acts on the expanding piston 302, thereby moving the piston assembly 210 in the downward direction (i.e., to the right in FIGS. 3A and 3B).

As the piston assembly 210 moves from the first end 301*a* to the second end 301*b* within the piston bore 208, the expanding piston 302 is configured to progressively expand and dynamically seal against the inner wall of the piston bore 208. More particularly, as the expanding piston 302 axially translates from the first end 301*a* to the second end 301*b*, the spring force built up in the leaves 410 of the expanding piston 302 may incrementally release such that the leaves 410 progressively expand and dynamically seal against the inner wall of the tapered portion 300. As used herein, the term "dynamic seal" is used to indicate a seal that provides pressure isolation between members that have relative displacement therebetween, for example, a seal that seals against a displacing surface, or a seal carried on one member and sealing against the other member, etc. A dynamic seal may comprise a material selected from the following: elastomeric materials, non-elastomeric materials, metals, composites, rubbers, ceramics, derivatives thereof, and any combination thereof. As indicated above, the dynamic seal may result from one or more seals positioned radially along the outer edge or portion of at least one of the expandable cones 402*a,b* that contact the inner wall of the tapered portion 300. Because of the sealing effect of the expanding piston, hydraulic fluids of the control pressure 310 may be substantially prevented from migrating past the expanding piston 302.

Referring to FIG. 3B, the piston assembly 210 has moved axially within the piston bore 208 such that the expanding piston 302 is arranged at or near the second end 301*b* of the tapered portion 300. While the piston assembly 210 moves from its first position into its second position, the piston rod 218 mechanically transfers the hydraulic force of the control pressure 310 to the flow tube 220 (FIGS. 2A-2B), thereby correspondingly displacing the flow tube 220 in the downward direction and opening the closure device 228 (FIG. 2B). Moreover, while the piston assembly 210 moves from its first position into its second position, the first and second expandable cones 402*a,b* progressively expand to sealingly engage the inner wall of the piston bore 208.

As the expanding piston 302 progressively expands, the effective piston area on which the control pressure 310 can act correspondingly increases. As a result, the opening force provided by the control pressure 310 also progressively increases as the safety valve 112 (FIGS. 2A-2B) moves from the closed to the open position. This may prove advantageous since the force of the power spring 236 also progressively increases as the safety valve 112 (FIGS. 2A-2B) moves from closed to open positions and compresses the power spring 236. Since the piston area of the expanding piston 302 progressively increases, the control pressure 310 required to open the safety valve 112 is correspondingly reduced, thereby effectively reducing the spread between opening pressure and closing pressure. The linearly-increasing piston area (and force) may prove useful in offsetting the increasing upward force from the power spring 236, thereby helping to reduce the opening pressure, or at least maintain the opening pressure constant during valve opening. As a result, an operator may be able to employ a smaller or reduced pressure control system used to convey the control pressure 310 to the safety valve 112, including using control lines and pump equipment that exhibit lower pressure ratings than would otherwise be used in a safety valve at similar depths. Smaller or reduced pressure control systems may be advantageous for safety reasons (i.e., lower pressures are typically safer than higher pressures), cost (i.e., reducing the size of the pump and the pressure rating of the pump and control lines can result in significant cost savings), and physical restraints (i.e., lower pressure equipment normally exhibits a smaller footprint than higher pressure equipment).

When it is desired to close the safety valve 112 (FIGS. 2A-2B), the control pressure 310 provided to the piston bore 208 may be reduced. Once the control pressure 310 is reduced, the spring force built up in the power spring 236, and any hydraulic pressure below the piston assembly 210, may serve to displace the piston assembly 210 back upwards within the piston bore 208 (e.g., to the left in FIGS. 3A and 3B). As the expanding piston 302 moves back towards the first end 301*a* of the tapered portion 300, the first and second expandable cones 402*a,b* may progressively contract while sealingly engaging the inner wall of the piston bore 208. Contracting the first and second expandable cones 402*a,b* may correspondingly decrease the piston area of the expanding piston 302. Advantageously, the closing pressure acting on the piston assembly 210 correspondingly decreases as the piston area of the expanding piston 302 decreases, as a result, the progressive contraction of the piston area may help reduce the spread between the opening and closing pressures.

In some embodiments, as illustrated in FIG. 3B, the piston assembly 210 may further include a secondary seal 312 axially offset from the expanding piston 302 and arranged on the piston rod 218 such that it moves simultaneously therewith. As illustrated, the secondary seal 312 may have or otherwise provide axially-extending lips that extend in the downward direction. Due to the general shape and orientation of the axially-extending lips, the control pressure 310 is able to bypass the secondary seal 312 while opening the safety valve 112, but may also be useful in preventing produced fluids that bypass the expanding piston 302 from travelling up the control line 116 (FIG. 1) while the safety valve 112 (FIGS. 2A and 2B) is moving back to its closed position. The secondary seal 312 may also prove advantageous in providing some hydraulic assistance to close the safety valve 112. In some embodiments, the secondary seal 312 may be an O-ring or the like. In other embodiments, as depicted, the secondary seal 312 may be a piston seal, such as a v-ring or CHEVRON® packing ring, or other appropriate seal configurations (e.g., seals that are round, v-shaped, u-shaped, square, oval, t-shaped, etc.). In yet other embodiments, the secondary seal 312 may be a rod seal configured to be inserted in a corresponding groove (not shown) defined in the housing 202.

Referring now to FIG. 5, with continued reference to FIGS. 3A and 3B, illustrated is an enlarged cross-sectional view of another embodiment of a piston assembly 500, according to one or more embodiments. The piston assembly 500 may be best understood with reference to the piston assembly 210 of FIGS. 3A-3B, where like numerals correspond to like components not described again in detail. The piston assembly 500 is arranged within the piston bore 208, and the piston bore 208 includes the tapered portion 300 having the first and second ends 301*a,b* described above.

The piston assembly 500 may include a first or upper expanding piston 502*a* and a second or lower expanding piston 502*b*. The first and second expanding pistons 502*a,b* may be substantially similar to the expanding piston 302 of FIGS. 4A-4E and therefore will not be described again in detail. In the illustrated embodiment, each of the first and second expanding pistons 502*a,b* may be coupled to the piston rod 218 using a retainer ring, similar to the retainer ring 412 of FIG. 4B described above. In other embodiments, however, the retainer ring may be omitted from one or both of the first and second expanding pistons 502*a,b* which may instead be coupled or otherwise attached to the piston rod 218 using one or more mechanical fasteners (e.g., screws, bolts, snap rings, pins, etc.), industrial adhesives, or via welding or shrink fitting.

As illustrated, the first and second expanding pistons 502*a,b* may be arranged on either side of the radial shoulder 306 defined on the piston rod 218. The first expanding piston 502*a* may generally face the direction of the first end 301*a* of the tapered portion 300 and the second expanding piston 502*b* may generally face the direction of the second end 301*b* of the tapered portion 300. The axial arrangement between the first and second expanding pistons 502*a,b* and the radial shoulder 306 may prove advantageous in holding pressure within the piston bore 208 as the piston assembly 500 axially translates therein between both its first and second positions.

More specifically, as the control pressure 310 is introduced into the piston bore, the first expanding piston 502*a* may be configured to assume and transfer the hydraulic force to the piston rod 218 at the radial shoulder 306. Axial engagement between the first expanding piston 502*a* and the radial shoulder 306 prevents the first expanding piston 502*a* from sliding along the outer surface of the piston rod 218. Similarly, during closing of the safety valve 112, the second expanding piston 502*b* may be configured to assume hydraulic pressure from section pressure 504 present within the safety valve 112 below the piston assembly 500, and may be configured to transfer the hydraulic force to the piston rod 218 at the radial shoulder 306. Axial engagement between the second expanding piston 502*b* and the radial shoulder 306 prevents the second expanding piston 502*b* from sliding along the outer surface of the piston rod 218.

Similar to the operation of the expanding piston 302 of FIGS. 4A-4E, the first and second expanding pistons 502*a,b* may be configured to move between contracted and expanded configurations while sealingly engaging the inner wall of the tapered portion 300 as the piston assembly 500 translates axially between the first and second ends 301*a,b*. The first expanding piston 502*a* may be configured to hold hydraulic pressure during opening, and the second expanding piston 502*b* may be configured to hold hydraulic pressure during closing. Accordingly, in such embodiments, the secondary seal 312 (FIG. 3B) may not be needed or otherwise required since the second expanding piston 502*b* may be used to generally prevent produced fluids from flowing up the control line 116 (FIG. 1).

Figure 6A:
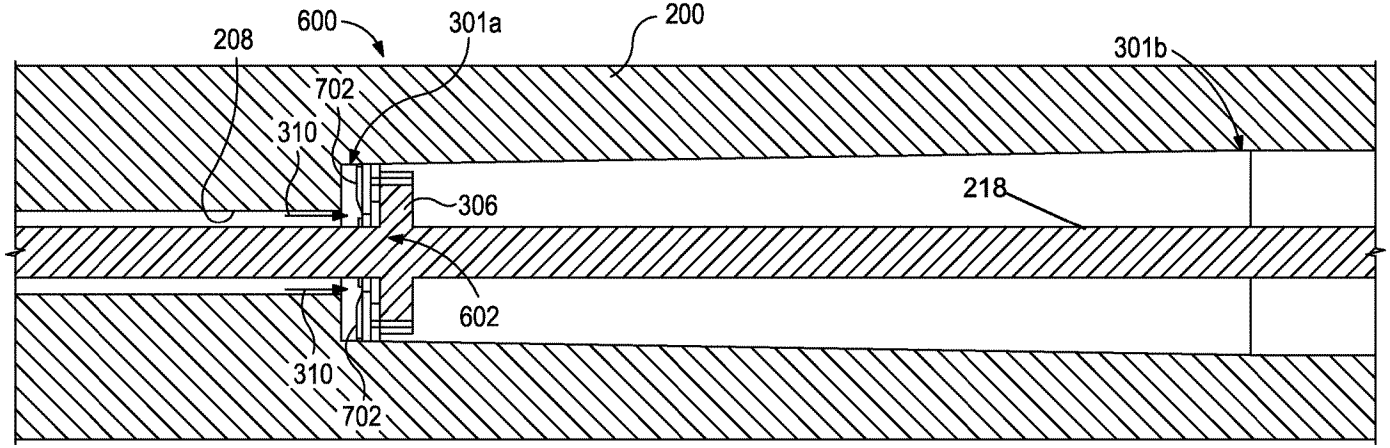
FIGS. 6A and 6B illustrate enlarged cross-sectional side views of an exemplary embodiment of another piston assembly, according to one or more embodiments.
Figure 6B:
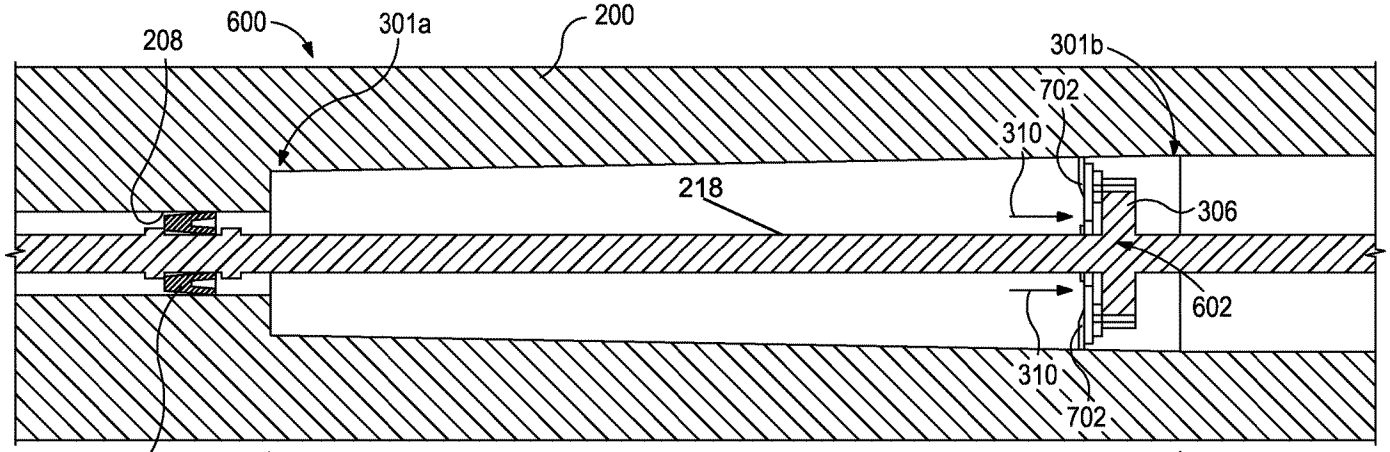

Referring now to FIGS. 6A and 6B, with continued reference to FIGS. 2A-2B and 3A-3B, illustrated are enlarged cross-sectional side views of another exemplary embodiment of a piston assembly 600 that may be used with the safety valve 112 of FIGS. 2A-2B, according to one or more embodiments. The piston assembly 600 may be best understood with reference to the piston assembly 210 of FIGS. 3A-3B, where like numerals correspond to like components not described again in detail. FIG. 6A depicts the piston assembly 600 in a first position, where the safety valve 112 is closed, as generally discussed above. FIG. 6B depicts the piston assembly 600 in a second position, where the safety valve 112 has been opened (or is otherwise moving toward being opened), as also generally discussed above.

As illustrated, the piston assembly 600 is arranged within the piston bore 208 including the tapered portion 300 that provides the first and second ends 301*a,b*, as described above. The piston assembly 600 may include an expanding piston 602 configured to expand and sealingly engage the inner wall of the tapered portion 300 as the piston assembly 600 moves between the first and second ends 301*a,b*. While moving from the first end 301*a* to the second end 301*b*, the expanding piston 602 may be configured to move between a contracted configuration, as shown in FIG. 6A, and an expanded configuration, as shown in FIG. 6B.

Similar to the expanding piston 302 of FIGS. 4A-4E, the expanding piston 602 may be mounted on or otherwise coupled to the piston rod 218 at or near the radial shoulder 306. In some embodiments, the expanding piston 602 may be mechanically fastened to the piston rod 218 using one or more bolts, screws, pins, rings, etc. In other embodiments, the expanding piston 602 may be welded or brazed to the piston rod 218 or attached thereto using industrial adhesives or heat shrinking. In yet other embodiments, the piston assembly 600 may further include a retainer ring (not shown) configured to hold the expanding piston 602 to the piston rod 218, similar to the retainer ring 412 of FIG. 4B.

Figure 7A:
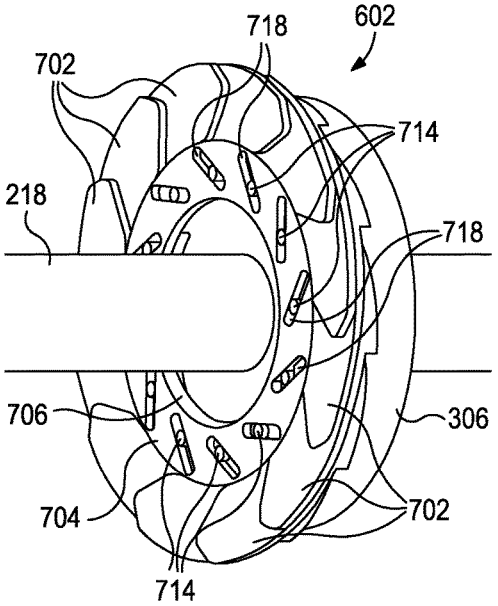
FIGS. 7A-7D illustrate views of the expanding piston of FIGS. 6A and 6B and components thereof, according to one or more embodiments.
Figure 7B:
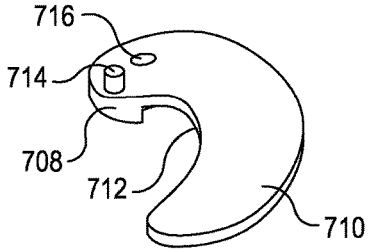
Figure 7C:
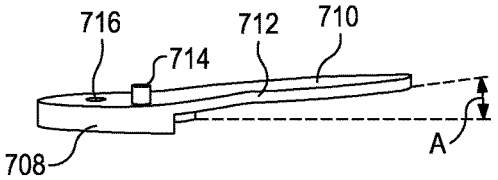
Figure 7D:
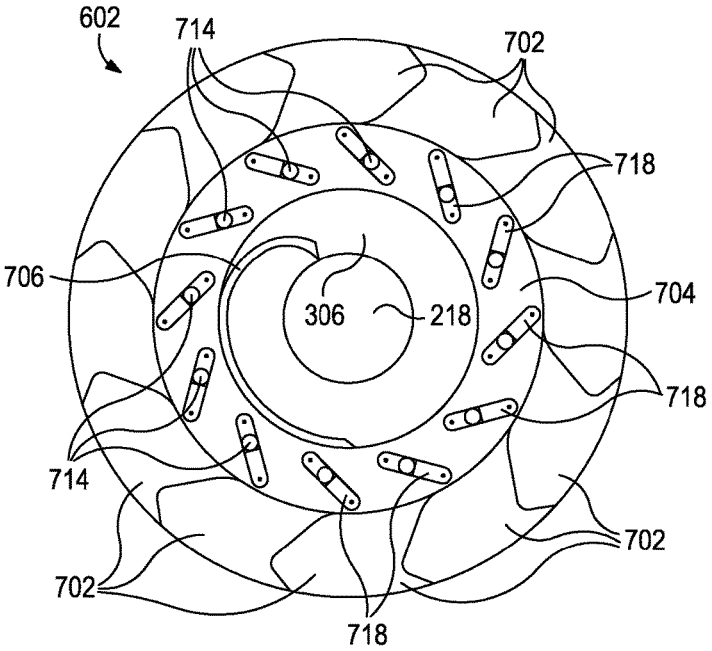

Referring to FIGS. 7A-7D, illustrated are various views of the expanding piston 602 and components thereof, according to one or more embodiments. More specifically, FIG. 7A depicts an isometric view of the expanding piston 602 in its contracted configuration as mounted on the piston rod 218, FIGS. 7B and 7C depict isometric and side views, respectively, of a leaf 702 of the expanding piston 602, and FIG. 7D depicts an end view of the expanding piston 602 in its contracted configuration as mounted on the piston rod 218. As depicted, the expanding piston 602 may include a plurality of radially-expandable leaves 702, a guide ring 704, and a torsion spring 706 (FIG. 7D).

The plurality of leaves 702 may be pivotably coupled to the guide ring 704 such that adjacent leaves 702 are interleaved or otherwise overlapping with each other about the circumference of the expanding piston 602. As seen in FIGS. 7B and 7C, each leaf 702 may include a body 708 and a blade 710 extending from the body 708. The blade 710 may extend from the body 708 at an angle A (FIG. 7C), which may be an angle ranging from about 1° to about 5°, to about 10°, to about 15°, or to about 20°. The angle A may be configured to allow adjacent leaves 702 to slidingly engage each other in an overlapping configuration when forming integral parts of the expanding piston 602. As a result, the angle A may be sufficiently large such that sliding engagement is accommodated between adjacent leaves 702.

Each blade 710 may be curved or otherwise define a curvature 712 configured to allow each leaf 702 to seat itself on the guide ring 704 when the expanding piston 602 is in the contracted configuration. Accordingly, the arcuate curve of the curvature 712 may generally correspond to the curved outer surface of the guide ring 704.

In some embodiments, overlapping blades 710 on adjacent leaves 702 may provide a generally sealed interface. For example, the interface (e.g., opposing front and back) between overlapping blades 710 may provide a metal-to-metal seal, thereby substantially preventing fluid migration through the expanding piston 602. In other embodiments, a sealant (not shown) may be disposed between overlapping blades 710 or each leaf 702 may otherwise be coated in the sealant such that the corresponding leaves 702 may be generally sealed. The sealant may include a layer of elastomer or rubber. In other embodiments, the sealant may be a thermoplastic layer, such as a layer of TEFLON® or the like. In operation, the sealant serves to prevent fluid migration through the expanding piston 602 via the leaves 702. In yet other embodiments, the outer radial edges of each leaf 702 may be coated with a sealant to aid sealing along the inner wall of the tapered portion 300 of the piston bore 208.

As best seen in FIGS. 7B and 7C, each leaf 702 may include a pivot pin 714 and define or otherwise provide a pivot point orifice 716. Each pivot pin 714 may be inserted within a corresponding slot 718 defined in the guide ring 704. In operation, the pivot pins 714 may be configured to slidingly engage and otherwise translate within the corresponding slots 718 in order to pivot the leaves 702 between contracted and expanded configurations. Each pivot point orifice 716 may be configured to receive a corresponding shoulder pin (not shown) defined on and extending longitudinally from the radial shoulder 306. Each leaf 702 may be configured to pivot about its corresponding shoulder pin as movably coupled to the respective pivot point orifice 716.

Referring to FIG. 7D, the torsion spring 706 (also known as a wrap spring) may be operatively coupled to the guide ring 704 or otherwise be configured to interact therewith to provide a constant spring force that urges the guide ring 704 to rotate in a first direction with respect to the piston rod 218. When allowed to rotate, the guide ring 704 forces the leaves 702 to radially expand. More particularly, as the guide ring 704 rotates, the pivot pins 714 of each leaf 702 slidingly engage and otherwise translate within their corresponding slots 718. In response thereto, each leaf 702 is forced to pivot about its corresponding shoulder pin provided on the radial shoulder 306 as movably coupled to the respective pivot point orifice 716. As the leaves 702 pivot, the corresponding blades 710 extend radially outward, thereby increasing the circumference of the expanding piston 602.

Referring again to FIGS. 6A and 6B, exemplary operation of the piston assembly 600 is now provided. In FIG. 6A, the safety valve 112 (FIGS. 2A-2B) is in its closed position, the piston assembly 600 is in its first position, and the expanding piston 602 is in its contracted configuration as arranged at or near the first end 301*a* of the tapered portion 300 of the piston bore 208. In its contracted configuration, the spring force of the torsion spring 706 (FIG. 7D) is built up or otherwise loaded such that the expanding piston 602 sealingly engages the inner wall of the piston bore 208. As the control pressure 310 is introduced into the piston bore 208, it communicates with and otherwise acts on the expanding piston 602, thereby moving the piston assembly 600 in the downward direction (i.e., to the right in FIGS. 6A and 6B).

As the piston assembly 600 moves from the first end 301*a* to the second end 301*b* within the piston bore 208, the expanding piston 602 progressively expands to dynamically seal against the inner wall of the piston bore 208. More specifically, as the expanding piston 602 axially translates from the first end 301*a* to the second end 301*b*, the spring force of the torsion spring 706 continuously urges the guide ring 704 to rotate in the first direction with respect to the piston rod 218, thereby forcing the leaves 702 to pivot and radially expand, as generally described above. Accordingly, the leaves 702 may progressively expand and dynamically seal against the inner wall of the tapered portion 300 as the piston assembly 600 axially translates within the piston bore 208.

Referring to FIG. 6B, the piston assembly 600 has moved axially within the piston bore 208 such that the expanding piston 602 is arranged at or near the second end 301*b* of the tapered portion 300. While the piston assembly 600 moves from its first position into its second position, the piston rod 218 mechanically transfers the hydraulic force of the control pressure 310 to the flow tube 220 (FIGS. 2A-2B), thereby correspondingly displacing the flow tube 220 in the downward direction and opening the closure device 228 (FIG. 2B).

As the expanding piston 602 progressively expands, the effective piston area on which the control pressure 310 can act correspondingly increases. As a result, the opening force provided by the control pressure 310 also progressively increases as the safety valve 112 (FIGS. 2A-2B) moves from the closed to the open position, thereby requiring a reduced amount of control pressure 310 to open the safety valve 112. As a result, an operator may be able to employ a smaller or reduced pressure control system.

When it is desired to close the safety valve 112 (FIGS. 2A-2B), the control pressure 310 provided to the piston bore 208 is reduced and the spring force built up in the power spring 236 (and any hydraulic pressure below the piston assembly 600) may serve to displace the piston assembly 600 back upwards within the piston bore 208 (e.g., to the left in FIGS. 6A and 6B). As the expanding piston 602 moves back towards the first end 301*a* of the tapered portion 300, the leaves 702 may follow the profile or shape of the piston bore 208 and progressively contract while sealingly engaging the inner wall of the piston bore 208. Contracting the leaves 702 may correspondingly rotate the guide ring 704 in a second direction opposite the first direction and thereby gradually building spring force again in the torsion spring 706. Moreover, contracting the leaves 702 may also correspondingly decrease the piston area of the expanding piston 602 such that the closing pressure acting on the piston assembly 600 correspondingly decreases as the piston area of the expanding piston 602 decreases. As will be appreciated, the progressive contraction of the piston area may help reduce the spread between the opening and closing pressures of the safety valve 112.

Similar to the piston assembly 210 of FIGS. 3A and 3B, in some embodiments the piston assembly 600 may further include the secondary seal 312 axially offset from the expanding piston 602 and arranged on the piston rod 218, as illustrated in FIG. 6B. Again, the secondary seal 312 may be designed and otherwise configured to prevent produced fluids that may bypass the expanding piston 602 from travelling up the control line 116 (FIG. 1) while the safety valve 112 (FIGS. 2A and 2B) is moving back to its closed position. Because of its general shape and orientation, the secondary seal 312 may also prove advantageous in providing some hydraulic assistance to close the safety valve 112.

Figure 8:
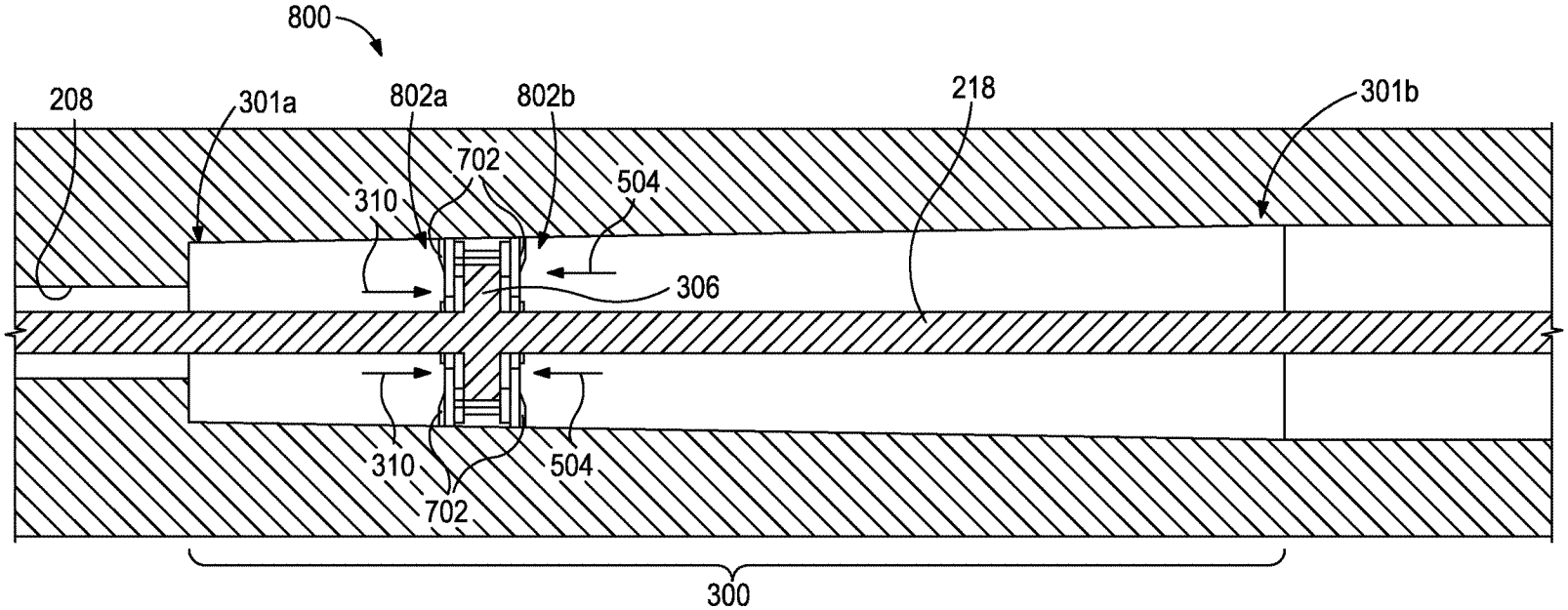
FIG. 8 illustrates an enlarged cross-sectional view of another embodiment of a piston assembly, according to one or more embodiments.

Referring now to FIG. 8, with continued reference to FIGS. 6A and 6B, illustrated is an enlarged cross-sectional view of another embodiment of an exemplary piston assembly 800 that may be used in conjunction with the safety valve 112 of FIGS. 2A and 2B, according to one or more embodiments. The piston assembly 800 may be best understood with reference to the piston assembly 600 of FIGS. 6A-6B, where like numerals correspond to like components not described again in detail. The piston assembly 800 is arranged within the piston bore 208, and the piston bore 208 includes the tapered portion 300 having the first and second ends 301*a,b* described above.

The piston assembly 800 may include a first or upper expanding piston 802*a* and a second or lower expanding piston 802*b*. The first and second expanding pistons 802*a,b* may be substantially similar to the expanding piston 602 of FIGS. 7A-7D and therefore will not be described again in detail. Each of the first and second expanding pistons 802*a,b* may be coupled to the piston rod 218, as generally described above. As illustrated, the first and second expanding pistons 802*a,b* may be arranged on either side of the radial shoulder 306 defined on the piston rod 218. The first expanding piston 802*a* may generally face the direction of the first end 301*a* of the tapered portion 300 and the second expanding piston 802*b* may generally face the direction of the second end 301*b* of the tapered portion 300. The axial arrangement between the first and second expanding pistons 802*a,b* and the radial shoulder 306 may prove advantageous in holding pressure within the piston bore 208 as the piston assembly 800 axially translates therein between the first and second positions.

More specifically, as the control pressure 310 is introduced into the piston bore, the first expanding piston 802*a* may be configured to assume the hydraulic pressure and transfer the hydraulic force to the piston rod 218 at the radial shoulder 306. Axial engagement between the first expanding piston 802*a* and the radial shoulder 306 prevents the first expanding piston 802*a* from sliding along the outer surface of the piston rod 218. Similarly, during closing of the safety valve 112, the second expanding piston 802*b* may be configured to assume hydraulic pressure from section pressure 504 present within the safety valve 112 below the piston assembly 800, and may be configured to transfer the hydraulic force to the piston rod 218 at the radial shoulder 306. Axial engagement between the second expanding piston 802*b* and the radial shoulder 306 prevents the second expanding piston 802*b* from sliding along the outer surface of the piston rod 218.

Similar to the operation of the expanding piston 602 of FIGS. 7A-7D, the first and second expanding pistons 802*a,b* may be configured to move between contracted and expanded configurations while sealingly engaging the inner wall of the tapered portion 300 as the piston assembly 800 translates axially therein. The first expanding piston 802*a* may be configured to hold hydraulic pressure during opening, and the second expanding piston 802*b* may be configured to hold hydraulic pressure during closing. Accordingly, the piston assembly 800 may provide a sealed interface along the tapered portion 300 of the piston bore as the piston assembly 800 moves in either direction therein. Moreover, in such embodiments, the secondary seal 312 (FIG. 3B) may not be needed or otherwise required since the second expanding piston 802*b* may be used to generally prevent produced fluids from flowing up the control line 116 (FIG. 1).

Embodiments disclosed herein include:

A. A safety valve that includes a housing having a piston bore defined therein and configured to receive hydraulic fluid pressure, the piston bore providing a tapered portion having a first end and a second end, wherein a cross-sectional diameter of the tapered portion progressively increases from the first end to the second end, and a piston assembly movably arranged within the piston bore and comprising a piston rod that extends longitudinally within at least a portion of the piston bore and an expanding piston coupled to the piston rod, wherein the expanding piston is configured to move between a contracted configuration and an expanded configuration to sealingly engage the tapered portion as the piston assembly moves between the first and second ends.

B. A method of actuating a safety valve that includes conveying hydraulic fluid pressure to a piston bore having a tapered portion with a first end and a second end and a cross-sectional diameter that progressively increases from the first end to the second end, axially displacing a piston assembly within the piston bore with the hydraulic fluid pressure, the piston assembly being movably arranged within the piston bore and comprising a piston rod that extends longitudinally within at least a portion of the piston bore and an expanding piston coupled to the piston rod, progressively moving the expanding piston between a contracted configuration and an expanded configuration as the piston assembly moves from the first end toward the second end of the tapered portion, and sealingly engaging an inner wall of the piston bore with the expanding piston as the piston assembly moves within the piston bore.

Each of embodiments A and B may have one or more of the following additional elements in any combination: Element 1: wherein the expanding piston is in the contracted configuration when arranged at or near the first end and the expanded configuration when arranged at or near the second end. Element 2: wherein the piston rod comprises an upper portion, a lower portion, and a radial shoulder arranged between the upper and lower portions. Element 3: wherein the expanding piston is arranged at or near the radial shoulder. Element 4: wherein the expanding piston is a first expanding piston arranged on the upper portion of the piston rod and facing toward the first end, the safety valve further comprising a second expanding piston arranged on the lower portion of the piston rod and facing toward the second end, the second expanding piston being configured to move between contracted and expanded configurations to sealingly engage the tapered portion as the piston assembly moves between the first and second ends. Element 5: wherein the expanding piston comprises an outer expandable cone having a first outer shroud and a first inner cylinder, and an inner expandable cone configured to nest within the outer expandable cone and having a second outer shroud and a second inner cylinder, wherein each of the first and second outer shrouds have one or more longitudinal slots defined therein to provide a plurality of leaves configured to expand when not radially constrained. Element 6: wherein the one or more longitudinal slots defined in the first shroud are angularly offset from the one or more longitudinal slots defined in the second shroud. Element 7: wherein a sealant is provided between the outer and inner expandable cones. Element 8: wherein the inner expandable cone is a first inner expandable cone, the expanding piston further comprising a second inner expandable cone also configured to nest within the outer expandable cone expand when not radially constrained. Element 9: wherein the expanding piston comprises a guide ring that defines a plurality of slots, a plurality of leaves pivotably coupled to the guide ring such that adjacent leaves of the plurality of leaves overlap with each other about a circumference of the expanding piston, wherein each leaf has a body and a blade that extends from the body, and wherein each leaf includes a pivot pin configured to be inserted within a corresponding one of the plurality of slots defined in the guide ring, and a torsion spring operatively coupled to the guide ring to provide a constant spring force that urges the guide ring to rotate with respect to the piston rod, wherein, when the guide ring is allowed to rotate, each pivot pin slidingly engages and translates within the corresponding one of the plurality of slots to pivot the plurality of leaves between the contracted and expanded configurations. Element 10: wherein the blade of each leaf extends from its corresponding body at an angle configured to allow adjacent leaves to slidingly engage each other in an overlapping configuration. Element 11: wherein the piston assembly further comprises a secondary seal axially offset from the expanding piston and arranged on the piston rod, the secondary seal being configured to prevent produced fluids that bypass the expanding piston from travelling up the piston bore. Element 12: further comprising a flow tube operably coupled to the piston rod and movably arranged within a flow passage defined in the safety valve in response to the movement of the piston assembly, a valve closure device movable between an open position and a closed position and adapted to restrict fluid flow through the flow passage when in the closed position, wherein the flow tube is adapted to shift the valve closure device between open and closed positions, and a power spring arranged within a lower chamber defined within the housing and configured to bias the piston assembly upwardly within the piston bore.

Element 13: wherein the expanding piston is a first expanding piston facing toward the first end and the piston assembly further includes a second expanding piston coupled to the piston rod and facing toward the second end, the method further comprising sealingly engaging the inner wall of the piston bore with the second expanding piston as the piston assembly moves between the first and second ends. Element 14: wherein the expanding piston comprises an outer expandable cone and one or more inner expandable cones nested within the outer expandable cone, and wherein each of the outer and one or more inner expandable cones define a plurality of radially-expanding leaves, the method further comprising expanding the plurality of radially-expanding leaves as the piston assembly moves from the first end to the second end and contracting the plurality of radially-expanding leaves as piston assembly moves from the second end to the first end. Element 15: wherein the plurality of leaves are defined by a corresponding plurality of longitudinal slots defined in each of the outer and one or more inner expandable cones, the method further comprising angularly offsetting the plurality of longitudinal slots defined in the outer expandable cone with the plurality of longitudinal slots defined in the one or more inner expandable cones, and sealing an interface between the outer and one or more inner expandable cones. Element 16: wherein the expanding piston comprises a guide ring defining a plurality of slots, a plurality of leaves pivotably coupled to the guide ring at a pivot pin associated with each leaf of the plurality of leaves and configured to be inserted within a corresponding one of the plurality of slots defined in the guide ring, and a torsion spring operatively coupled to the guide ring, the method further comprising urging the guide ring to rotate in a first direction with a spring force of the torsion spring, slidingly engaging the plurality of slots with the pivot pin associated with each leaf when the guide ring rotates in the first direction, pivoting the plurality of leaves radially outward to a radially expanded configuration when the guide ring rotates in the first direction, and pivoting the plurality of leaves radially inward to a radially contracted configuration when the guide ring rotates in a second direction opposite the first direction. Element 17: wherein each leaf comprises a body and a blade that extends from the body, and wherein the blade of each leaf extends from its corresponding body at an angle, the method further comprising slidingly engaging adjacent leaves in an overlapping configuration when the guide ring rotates in the first direction. Element 18: further comprising increasing a piston area of the expanding piston as the piston assembly moves from the first end to the second end. Element 19: wherein the piston rod is operably coupled to a flow tube movably arranged within a flow passage defined in the safety valve, the method further comprising axially displacing the flow tube as the piston assembly moves within the piston bore, compressing a power spring as the piston assembly is axially displaced by the hydraulic fluid pressure, and moving a valve closure device with the flow tube from a closed position which restricts fluid flow through the flow passage to an open position.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A safety valve, comprising:

a housing having a piston bore defined therein and configured to receive hydraulic fluid pressure, the piston bore providing a tapered portion having a first end and a second end, wherein a cross-sectional diameter of the tapered portion progressively increases from the first end to the second end; and a piston assembly movably arranged within the piston bore and comprising a piston rod that extends longitudinally within at least a portion of the piston bore and an expanding piston coupled to the piston rod, wherein the expanding piston includes a plurality of overlapping leaves biased toward an expanded configuration, and wherein, as the piston assembly moves between the first and second ends, the plurality of overlapping leaves move between a contracted configuration and the expanded configuration to sealingly engage the tapered portion.

2. The safety valve of claim 1, wherein the expanding piston is in the contracted configuration when arranged at or near the first end and the expanded configuration when arranged at or near the second end.

3. The safety valve of claim 1, wherein the piston rod comprises an upper portion, a lower portion, and a radial shoulder arranged between the upper and lower portions.

4. The safety valve of claim 3, wherein the expanding piston is arranged at or near the radial shoulder.

5. The safety valve of claim 3, wherein the expanding piston is a first expanding piston arranged on the upper portion of the piston rod and facing toward the first end, the safety valve further comprising:

a second expanding piston arranged on the lower portion of the piston rod and facing toward the second end, the second expanding piston being configured to move between contracted and expanded configurations to sealingly engage the tapered portion as the piston assembly moves between the first and second ends.

6. The safety valve of claim 1, wherein the expanding piston comprises:

an outer expandable cone having a first outer shroud and a first inner cylinder; and an inner expandable cone configured to nest within the outer expandable cone and having a second outer shroud and a second inner cylinder, wherein each of the first and second outer shrouds have one or more longitudinal slots defined therein to provide the plurality of leaves.

7. The safety valve of claim 6, wherein the one or more longitudinal slots defined in the first outer shroud are angularly offset from the one or more longitudinal slots defined in the second outer shroud.

8. The safety valve of claim 6, wherein a sealant is provided between the outer and inner expandable cones.

9. The safety valve of claim 6, wherein the inner expandable cone is a first inner expandable cone, the expanding piston further comprising a second inner expandable cone also configured to nest within the outer expandable cone expand when not radially constrained.

10. The safety valve of claim 1, wherein the expanding piston comprises:

a guide ring that defines a plurality of slots;

the plurality of leaves pivotably coupled to the guide ring such that adjacent leaves of the plurality of leaves overlap with each other about a circumference of the expanding piston, wherein each leaf has a body and a blade that extends from the body, and wherein each leaf includes a pivot pin configured to be inserted within a corresponding one of the plurality of slots defined in the guide ring; and a torsion spring operatively coupled to the guide ring to provide a constant spring force that urges the guide ring to rotate with respect to the piston rod, wherein, when the guide ring is allowed to rotate, each pivot pin slidingly engages and translates within the corresponding one of the plurality of slots to pivot the plurality of leaves between the contracted and expanded configurations.

11. The safety valve of claim 10, wherein the blade of each leaf extends from its corresponding body at an angle configured to allow adjacent leaves to slidingly engage each other in an overlapping configuration.

12. The safety valve of claim 1, wherein the piston assembly further comprises a secondary seal axially offset from the expanding piston and arranged on the piston rod, the secondary seal being configured to prevent produced fluids that bypass the expanding piston from travelling up the piston bore.

13. The safety valve of claim 1, further comprising:

a flow tube operably coupled to the piston rod and movably arranged within a flow passage defined in the safety valve in response to the movement of the piston assembly;

a valve closure device movable between an open position and a closed position and adapted to restrict fluid flow through the flow passage when in the closed position, wherein the flow tube is adapted to shift the valve closure device between open and closed positions; and a power spring arranged within a lower chamber defined within the housing and configured to bias the piston assembly upwardly within the piston bore.

14. A method of actuating a safety valve, comprising:

conveying hydraulic fluid pressure to a piston bore having a tapered portion with a first end and a second end and a cross-sectional diameter that progressively increases from the first end to the second end;

axially displacing a piston assembly within the piston bore with the hydraulic fluid pressure, the piston assembly being movably arranged within the piston bore and comprising a piston rod that extends longitudinally within at least a portion of the piston bore and an expanding piston coupled to the piston rod, wherein the expanding piston includes a plurality of overlapping leaves biased toward an expanded configuration;

progressively moving the plurality of overlapping leaves between a contracted configuration and the expanded configuration as the piston assembly moves from the first end toward the second end of the tapered portion; and sealingly engaging an inner wall of the piston bore with the plurality of overlapping leaves as the piston assembly moves within the piston bore.

15. The method of claim 14, wherein the expanding piston is a first expanding piston facing toward the first end and the piston assembly further includes a second expanding piston coupled to the piston rod and facing toward the second end, the method further comprising:

sealingly engaging the inner wall of the piston bore with the second expanding piston as the piston assembly moves between the first and second ends.

16. The method of claim 14, wherein the expanding piston comprises an outer expandable cone and one or more inner expandable cones nested within the outer expandable cone, and wherein each of the outer and one or more inner expandable cones define the plurality of radially-expanding leaves, the method further comprising:

expanding the plurality of radially-expanding leaves as the piston assembly moves from the first end to the second end; and contracting the plurality of radially-expanding leaves as piston assembly moves from the second end to the first end.

17. The method of claim 16, wherein the plurality of leaves are defined by a corresponding plurality of longitudinal slots defined in each of the outer and one or more inner expandable cones, the method further comprising:

angularly offsetting the plurality of longitudinal slots defined in the outer expandable cone with the plurality of longitudinal slots defined in the one or more inner expandable cones; and sealing an interface between the outer and one or more inner expandable cones.

18. The method of claim 14, wherein the expanding piston comprises a guide ring defining a plurality of slots, the plurality of leaves pivotably coupled to the guide ring at a pivot pin associated with each leaf of the plurality of leaves and configured to be inserted within a corresponding one of the plurality of slots defined in the guide ring, and a torsion spring operatively coupled to the guide ring, the method further comprising:

urging the guide ring to rotate in a first direction with a spring force of the torsion spring;

slidingly engaging the plurality of slots with the pivot pin associated with each leaf when the guide ring rotates in the first direction;

pivoting the plurality of leaves radially outward to a radially expanded configuration when the guide ring rotates in the first direction; and pivoting the plurality of leaves radially inward to a radially contracted configuration when the guide ring rotates in a second direction opposite the first direction.

19. The method of claim 18, wherein each leaf comprises a body and a blade that extends from the body, and wherein the blade of each leaf extends from its corresponding body at an angle, the method further comprising slidingly engaging adjacent leaves in an overlapping configuration when the guide ring rotates in the first direction.

20. The method of claim 14, further comprising increasing a piston area of the expanding piston as the piston assembly moves from the first end to the second end.

21. The method of claim 14, wherein the piston rod is operably coupled to a flow tube movably arranged within a flow passage defined in the safety valve, the method further comprising:

axially displacing the flow tube as the piston assembly moves within the piston bore;

compressing a power spring as the piston assembly is axially displaced by the hydraulic fluid pressure; and moving a valve closure device with the flow tube from a closed position which restricts fluid flow through the flow passage to an open position.

* * * * *